US006321759B1

(12) United States Patent
Okamura et al.

(10) Patent No.: US 6,321,759 B1
(45) Date of Patent: Nov. 27, 2001

(54) METHOD FOR CLEANING A SUBSTRATE

(75) Inventors: Ryuji Okamura, Kyoto; Toshiyasu Shirasuna, Nara; Kazuhiko Takada, Nara; Kazuyoshi Akiyama, Nara; Hitoshi Murayama, Kyoto; Kazuto Hosoi, Nara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/218,086

(22) Filed: Dec. 22, 1998

(30) Foreign Application Priority Data

Dec. 26, 1997 (JP) ..... 9-361301

(51) Int. Cl.[7] ..... B08B 3/02; B08B 9/02
(52) U.S. Cl. ..... 134/22.11; 134/22.12
(58) Field of Search ..... 134/2, 22.11, 22.12, 134/22.18, 24, 32, 34; 427/578

(56) References Cited

U.S. PATENT DOCUMENTS

| | | | | |
|---|---|---|---|---|
| 4,504,518 | | 3/1985 | Ovshinsky et al. | 427/38 |
| 4,552,594 | * | 11/1985 | Van Voskuilen et al. | 134/34 |
| 5,052,423 | * | 10/1991 | Chapman et al. | 134/174 |
| 5,226,973 | * | 7/1993 | Chapman et al. | 134/34 |
| 5,265,634 | * | 11/1993 | Chapman et al. | 134/181 |
| 5,480,754 | * | 1/1996 | Takei et al. | 430/65 |

FOREIGN PATENT DOCUMENTS

| | | |
|---|---|---|
| 54-86341 | 7/1979 | (JP) . |
| 59-193463 | 11/1984 | (JP) . |
| 60-186849 | 9/1985 | (JP) . |
| 60-262936 | 12/1985 | (JP) . |
| 61-231561 | 10/1986 | (JP) . |
| 61-283116 | 12/1986 | (JP) . |
| 62-95545 | 5/1987 | (JP) . |
| 3-205824 | 9/1991 | (JP) . |
| 6-273955 | 9/1994 | (JP) . |

* cited by examiner

*Primary Examiner*—Randy Gulakowski
*Assistant Examiner*—Saeed Chaudhry
(74) *Attorney, Agent, or Firm*—Fitzpatrick, Cella, Harper & Scinto

(57) ABSTRACT

A cleaning method for an electrophotographic photosensitive member that eliminate corrosion and cleaning irregularities of a substrate during cleaning, and a method of producing an electrophotographic photosensitive member which is easy to operate and capable of stably forming the photosensitive member at a low cost, in a high yield, and at a high speed. The cleaning method is a water-based cleaning method of cleaning a cylindrical substrate for an electrophotographic photosensitive member, using at least one selected from the group consisting of pure water, pure water having dissolved carbon dioxide, and pure water containing a surface active agent, wherein the cylindrical substrate is cleaned by a cleaning liquid ejected from a plurality of nozzles, and wherein those surfaces of the cleaning liquid ejected from the respective nozzles which are in contact with a surface of the cylindrical substrate do not interfere with each other, and the cleaning apparatus is arranged to carry out the cleaning method.

6 Claims, 6 Drawing Sheets

METHOD FOR CLEANING A SUBSTRATE

BACKGROUND OF THE INVENTION

1. Field of the Invention

The present invention relates to a method and apparatus for cleaning a substrate for an electrophotographic photosensitive member and a method of producing an electrophotographic photosensitive member having a functional film formed therein.

2. Related Background Art

As the material of a substrate for forming a deposited film of an electrophotographic photosensitive member thereon, there have been proposed glass, heat-resistant synthetic resin, stainless steel, aluminum, and so on. In practice, however, metals are frequently used in order to stand the electrophotographic process including steps of charging, exposure, development, image transfer, and cleaning and to keep positional accuracy always high enough to prevent degradation of quality of image. Of the metals, aluminum is one of the most suitable materials as a substrate of the electrophotographic photosensitive member because of its good workability, low cost, and light weight.

Techniques concerning the material for the substrate of the electrophotographic photosensitive member are described in Japanese Patent Application Laid-Open Nos. 59-193463 and 60-262936. Japanese Patent Application Laid-Open No. 59-193463 discloses the technology for obtaining an amorphous silicon electrophotographic photosensitive member to implement good quality of image, by employing a support of an aluminum alloy containing Fe in the content of not more than 2000 ppm. Further, this application also discloses procedures for cutting a cylindrical (cylinder-shape) substrate by a lathe, mirror-finishing the surface thereof, and thereafter forming amorphous silicon thereon by a glow discharge.

Japanese Patent Application Laid-Open No. 60-262936 discloses an extruded aluminum alloy excellent in evaporativity of amorphous silicon thereon, the extruded aluminum alloy containing Mg of 3.0 to 6.0 wt %, impurities of Mn not more than 0.3% by weight, Cr less than 0.01% by weight, Fe not more than 0.15% by weight, and Si not-more than 0.12% by weight, and Al the rest.

These materials are subjected to surface processing for the substrate according to use of the electrophotographic photosensitive member and a light receiving layer is formed on the surface. Techniques concerning the surface processing of the substrate are described in Japanese Patent Application Laid-Open Nos. 61-231561 and 62-95545. As corrosion inhibiting technology in a water cleaning step where an aluminum alloy Is used as a substrate, Japanese Patent Application Laid-Open No. 6-273955 suggests the technology for cleaning the substrate with water containing dissolved carbon dioxide, but fails to describe carrying out cleaning such that those surfaces of liquid ejected from nozzles which are in contact with the surface of a cylindrical substrate do not interfere with each other.

Japanese Patent Application Laid-Open No. 3-205824 discloses the technology for clearing comprising jetting high-pressure liquid, but fails to describe carrying out cleaning such that those surfaces of liquid ejected from nozzles which are in contact with the surface of a cylindrical substrate do not interfere with each other.

As the technique for device materials used in the electrophotographic photosensitive member, there have been proposed a variety of materials including selenium, cadmium sulfide, zinc oxide, amorphous silicon, organic material such as phthalocyanine, and so on. Among them, non-monocrystalline deposited films containing the principal component of silicon atoms, typified by amorphous silicon, for example, amorphous deposited films such as amorphous silicon compensated by hydrogen and (/or) halogen (for example, fluorine, chlorine, etc.) or the like, are proposed as high-performance, high-durability, and nonpolluting photosensitive members, and some of them are practically used. Japanese Patent Application Laid-Open No. 54-86341 discloses the technology of the electrophotographic photosensitive member in which the photoconductive layer is formed mainly of amorphous silicon.

As the method of forming such a non-monocrystalline deposited film containing the principal component of silicon atoms, there have hitherto been known many methods such as sputtering, a method of decomposing a source gas by heat (thermal CVD method), a method of decomposing a source gas by light (photo CVD method), a method of decomposing a source gas by plasma (plasma CVD method), and so on.

The plasma CVD method, which is a method of decomposing a source gas by direct current, high frequency wave, or microwave glow discharge or the like to form a thin deposited film on a substrate, is most suitable for formation of the amorphous silicon deposited film for electrophotography and practical use thereof is now well in progress. Among others, the plasma CVD method using decomposition by microwave glow discharge as the deposited film forming method, i.e., the microwave plasma CVD method is drawing attention industrially in recent years.

The microwave plasma CVD method has advantages of high deposition rate and high source gas utilization efficiency as compared with the other methods. An example of the microwave plasma CVD technology making use of such advantages is described in U.S. Pat. No. 4,504,518. The technology described in the patent is one for obtaining a deposited film with high quality at a high deposition rate under the low pressure of not more than 0.1 Torr by the microwave plasma CVD method.

Further, the technology for improving the utilization efficiency of a source gas by the microwave plasma CVD method is described in Japanese Patent Application Laid-Open No. 60-186849. The technology described in the Lead-Open gazette can be summarized as technology for achieving very high source gas utilization efficiency by the arrangement in which substrates are disposed so as to surround a means for introducing a microwave energy to form an internal chamber (i.e., a discharge space).

Moreover, Japanese Patent Application Laid-Open No. 61-283116 discloses improved microwave technology for production of a semiconductor member. Specifically, the Laid-Open gazette discloses the technology for improving characteristics of a deposited film by providing an electrode (bias electrode) for control of the plasma potential in a discharge space, applying a desired voltage (bias voltage) to this bias electrode, and thereby carrying out film deposition while controlling ion bombardment against the deposited film.

When a cylinder of an aluminum alloy is used as a substrate, the method of producing the electrophotographic photosensitive member according to these conventional techniques is carried out specifically as follows.

The substrate Is machined to a flatness of surface within a predetermined range by cutting with a diamond cutting tool set in a lathe, a milling machine, or the like as occasion demands, and then is cleaned with trichloroethane. After this surface processing, the substrate is then cleaned with trichloroethane and a deposited film the matrix of which is amorphous silicon is formed on the substrate.

Further, in the electrophotographic photosensitive members according to the conventional technologies there were many abnormally grown portions, i.e., portions of small area where surface charge was not carried, in the deposited film. These abnormally grown portions appeared particularly prominent in the electrophotographic photosensitive members having the deposited film formed by the plasma CVD method, particularly, like amorphous silicon. Thus, it was conventional practice to decrease the number of those portions where the surface charge was not carried, by optimizing the surface processing conditions of substrates, cleaning conditions, and deposition conditions. Further, the higher resolution in development was not demanded heretofore than at present, go that such portions posed no practical problem before.

However, in recent years, such small portions where charge was not carried have been pointed out as image defects, under the following circumstances: (1) high quality of image was demanded for the electrophotographic apparatus and the resolution in development was being increased therewith, and (2) progress in increase of the copying speed of copying machines made charging conditions severer and the portions carrying no charge in the surface came to greatly affect the potentials around them substantially.

Further, conventional uses of copies were mainly copies of originals including only letters (so-called line copies), so that these image defects were not so prominent in practical use.

However, with increase of copies of originals including halftones such as photographs in recent years, further improvement has been demanded in the quality of image of the copying machines. Particularly, further improvement in the quality of image is desired in color copying machines having popularly been used recently Incidentally, since the abnormally grown portions are very small, it is very difficult to detect them even by measurement of electric conductivity by an electrode placed thereon. Further, when the charging, exposure, and development steps are carried out in the electrophotographic process on the electrophotographic photosensitive member, particularly, when a uniform image is formed in halftone, a small potential difference on the surface of the electrophotographic photosensitive member appears visually outstanding as an image defect. Particularly, in the electrophotographic photosensitive member made by the microwave plasma CVD method, the aforementioned issue appears further prominent.

In addition, such image defects appear particularly prominent in the electrophotographic photosensitive members made by the plasma CVD method, as compared with the Se electrophotographic photosensitive members made by vacuum evaporation and the OPC electrophotographic photosensitive members made by the blade coating method or the dipping method or the like. In contrast with it, in the case of devices prepared in the similar fashion to the electrophotographic photosensitive members by the plasma CVD method, the overall performance of the devices will not be affected even if there are small differences of electric characteristics among positions on the substrate of the devices; or, in the case of devices that can be corrected by a post-treatment after the preparation by the CVD method, the aforementioned issue will not arise An example of the devices referred to herein is a solar cell.

Moreover, in the conventional techniques trichloroethane was used for cleaning the substrate. However, such chlorine base solvents are not allowed to use without care because of the recent environmental issues, and water bass cleaning has been used instead. However, when aluminum was cleaned with water, cleaning irregularities were not perfectly eliminated by simply ejecting a cleaning fluid under a high pressure. In addition, portions having many impurities (Si etc.) exposed in part in the surface of aluminum sometimes formed local batteries with normal aluminum portions around them, thereby promoting corrosion of the surface of the substrate.

SUMMARY OF THE INVENTION

The present invention has been accomplished in view of the above points and an object of the invention is to solve the above-stated various problems in the cleaning methods and cleaning apparatus for cleaning the substrate for electrophotography as described above and to solve the various problems in the above-stated conventional production methods of electrophotographic photosensitive member in the plasma CVD method.

An object of the present invention is to provide a cleaning method and a cleaning apparatus for an electro-photographic photosensitive member that can eliminate the corrosion and cleaning irregularities of the substrate during cleaning.

A further object of the present invention is to provide a method of producing an electrophotographic photosensitive member easy to use, which is capable of stably forming a photosensitive member at a low cost, at a high speed and in a high yield, overcoming the various problems in the above-stated conventional production methods of electrophotographic photosensitive members in the plasma CVD method.

That is, the cleaning method and cleaning apparatus for cleaning a cylindrical substrate for an electrophotographic photosensitive member according to the present invention are a water base cleaning method and cleaning apparatus using at least one selected from the group consisting of pure water, pure water having dissolved carbon dioxide, and pure water containing a surface active agent, wherein the cylindrical substrate for the electrophotographic photosensitive member is cleaned with a cleaning liquid ejected from a plurality of nozzles, and wherein those surfaces of the cleaning liquid ejected from the respective nozzles which are in contact with a surface of the cylindrical substrate do not interfere with each other Further, the present invention can be accomplished more effectively and practically by either one of such features that the distances between liquid ejection ports of the nozzles and the surface of the cylindrical substrate vary depending upon the diameter of the cylindrical substrate, that at least either the cylindrical substrate or the nozzles move during the cleaning step, that the ejection pressure from the nozzles is 5 to 50 kgf/cm$_2$, and that the cylindrical substrate is of an aluminum alloy in which the total content of Fe+Si+Cu is within the range of 0.001 to 1% by weight.

Further, the method of producing an electrophotographic photosensitive member according to the present invention is characterized in that a cylindrical substrate cleaned by the above-stated cleaning method and cleaning apparatus is used, and a functional film comprised of an amorphous material comprising silicon atoms as a matrix is formed on the surface of the substrate by a low pressure vapor phase growth method.

The present invention further provides a cleaning method comprising spraying a liquid from mutually different positions onto the substrate to clean the substrate, wherein the liquid is sprayed onto the substrate such that a plurality of regions in the substrate to which the liquid is sprayed do not overlap with each other.

The present invention still further provides a substrate cleaning apparatus comprising a plurality of nozzles disposed at mutually different positions, for spraying a liquid from the nozzles onto a substrate to clean the substrate, wherein the plurality of nozzles are placed such that a plurality of regions in the substrate to which the liquid is sprayed do not overlap with each other.

DETAILED DESCRIPTION OF THE PREFERRED EMBODIMENTS

The embodiments of the present invention will be described in detail, but it should be noted that the present invention is by no means intended to be limited to these embodiments.

Figure 1:
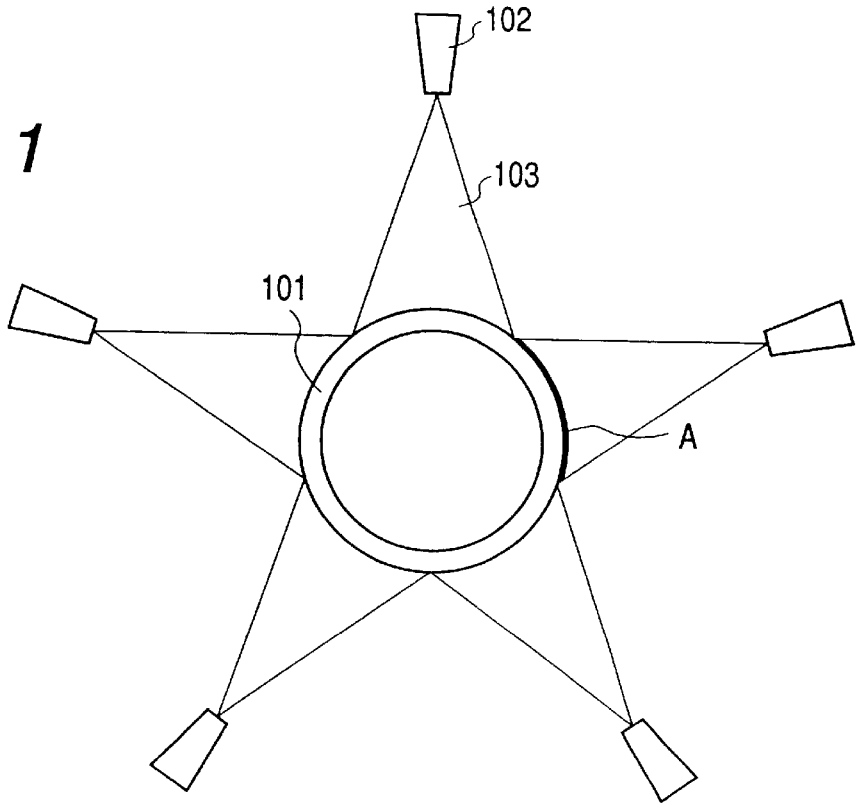
FIG. 1 is a schematic view which shows ejection of liquid from nozzles according to the present invention.

FIG. 1 is a schematic view showing a cleaning method of the present invention. In FIG. 1, reference numeral 101 designates a cylindrical substrate for an electrophotographic photosensitive member, 102 nozzles for ejecting a cleaning liquid, and 103 spread ranges of the cleaning liquid ejected from the respective nozzles, which are illustrated as a schematic view from above the cylindrical substrate 101. The ejection angles and the distances between the cylindrical substrate surface and the tips of the nozzles are set before or during cleaning of the substrate so that a surface (or surface region) (i.e., surface A in the figure) at which the cleaning solution 103 ejected from each of the plurality of nozzles 102 arranged at the same height and at equal intervals with respect to the cylindrical substrate strikes the cylindrical substrate and which can be cleaned substantially does not overlap with (or do not interfere with) those surfaces (surface regions) at which the cleaning liquid ejected from the other nozzles strikes against the cylindrical substrate. As the cleaning liquid, there can be included pure water, pure water containing more carbon dioxide than usual, pure water containing a surface active agent, and so on.

Figure 2:
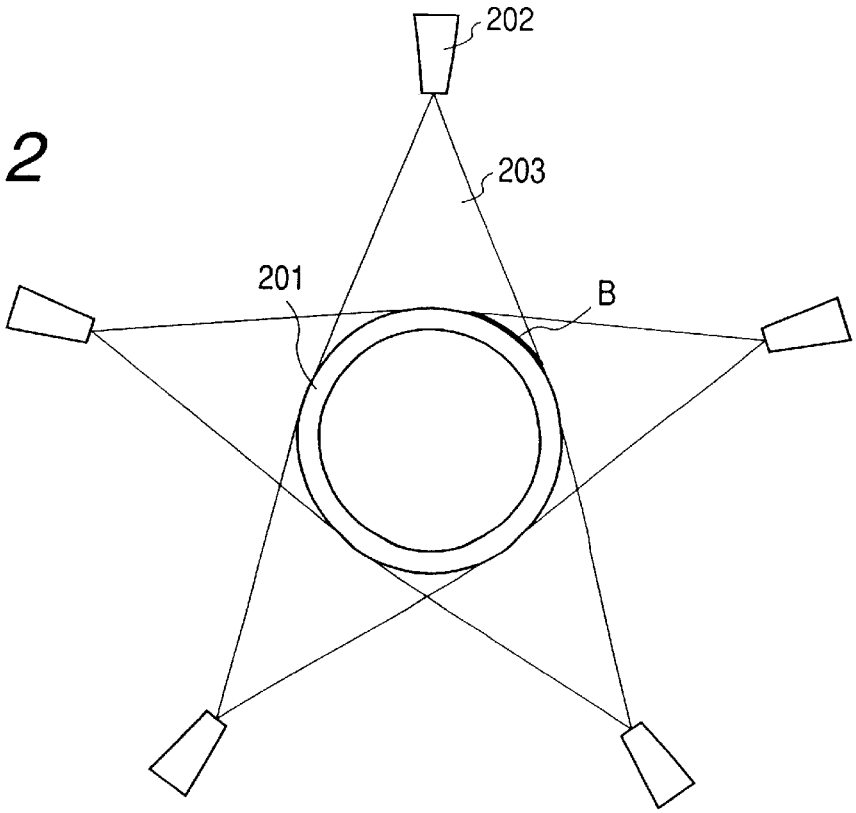
FIG. 2 is a schematic view showing ejection of liquid from nozzles.

FIG. 2 is a schematic view showing an example in which the nozzles eject the liquid and the liquid sprays overlap with each other. In FIG. 2, reference numeral 201 denotes a cylindrical substrate for an electrophotographic photosensitive member, 202 nozzles for ejecting the cleaning liquid, and 203 spread ranges of the cleaning liquid ejected from the respective nozzles, which schematically show traces of the cleaning liquid. As illustrated in FIG. 2, the cleaning liquid 203 ejected from each nozzle 202 has overlapping (interfering) portions with the cleaning liquid ejected from adjacent nozzles, in the region of surface B in the figure. This varies cleaning states part by part on the cylindrical substrate 201 and weakens the cleaning effect in the overlapping portions, thus becoming the cause of cleaning stains and cleaning irregularities.

Figure 3A:
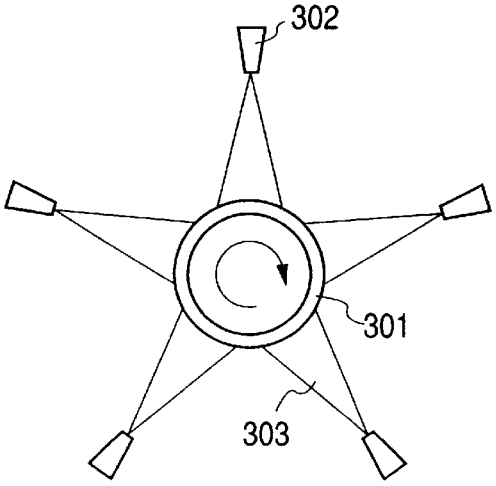
FIGS. 3A, 3B and 3C are schematic views which explain examples of the cleaning method of the present invention.
Figure 3B:
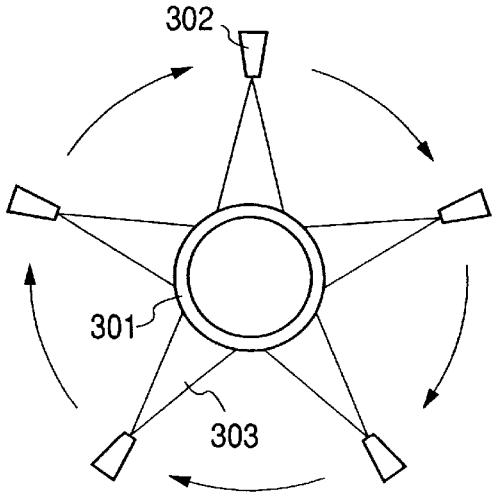
Figure 3C:
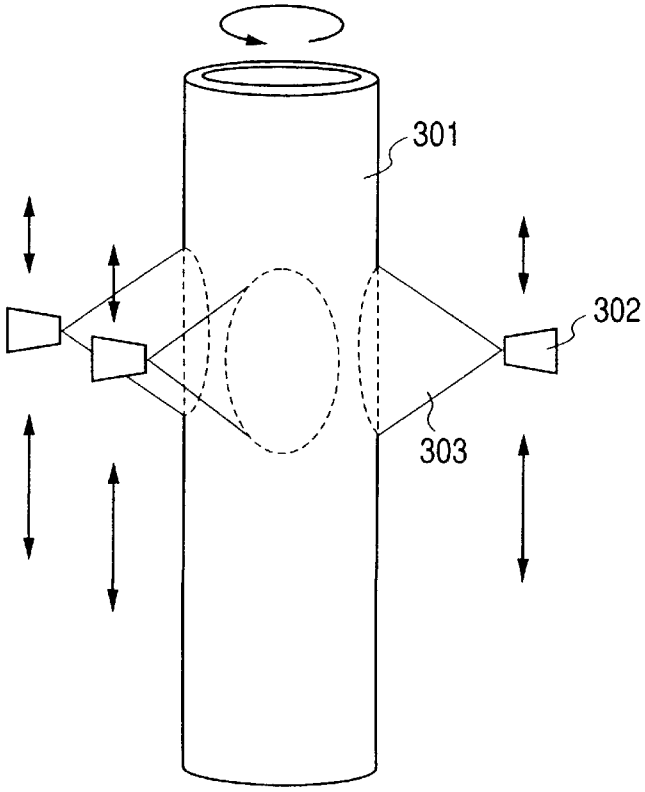

FIGS. 3A to 3C are views schematically showing examples of further application of the cleaning method according to the present invention. Thee are two examples of the method of uniformly cleaning the entire surface of the cylindrical substrate 301 for the electrophotographic photosensitive member. One of them is a method of cleaning the cylindrical substrate 301 while rotating it, the cleaning state of which is illustrated in FIG. 3A. Alternatively, as another example illustrated in FIG. 3B, it is possible to rotate the nozzles so that the entire circumference of the cylindrical substrate is cleaned uniformly. A combination of these two examples is also preferred for uniformly cleaning the entire surface of the cylindrical substrate 301. Further, as illustrated in FIG. 3C, it is practical to uniformly clean the entire surface of the cylindrical substrate 301 by vertically moving the nozzles 302 while rotating the cylindrical substrate 301. It is also effective in the present invention to clean the cylindrical substrate by rotating and vertically moving the cylindrical substrate without moving the nozzles 302. Alternatively, another effective means in the present invention is to rotate and vertically move the nozzles 302 without moving the cylindrical substrate.

Figure 4A:
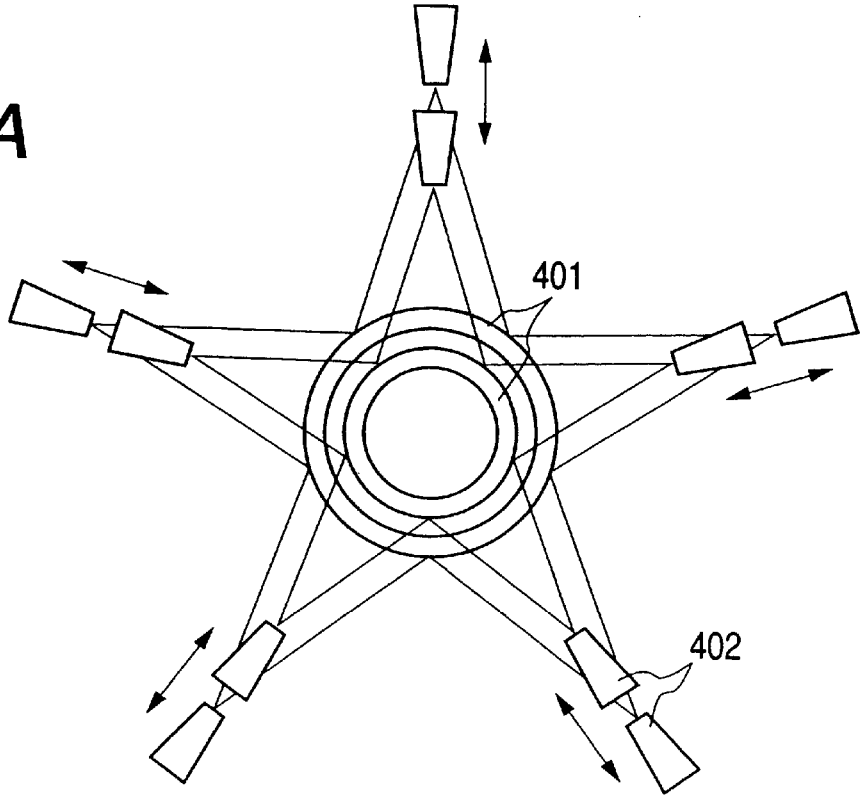
FIGS. 4A and 4B are schematic view which show the situation in which the nozzles are moved depending upon the outside diameter of the cylindrical substrate.
Figure 4B:
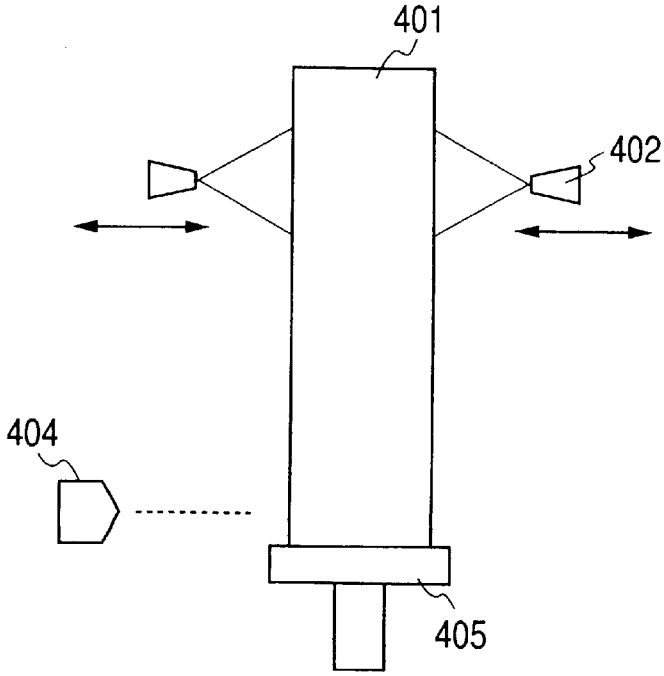

FIGS. 4A and 4B are schematic diagrams to explain an arrangement in which the size of surface A, described in FIG. 1, is changed by changing the positions of the nozzles 402, according to the outside diameter of the cylindrical substrate. In this case, it is practical to provide an unrepresented mechanism for changing the distances between the tips of the nozzles 402 and the surface of the cylindrical substrate 401, according to the outside diameter of the cylindrical substrate to be cleaned. Supposing that a plurality of cylindrical substrates of different outside diameters are successively cleaned and, for example, that a cylindrical substrate having a smaller outside diameter than in the previous step has to be cleaned in a next step, the contact surfaces between the cleaning liquid and the surface of the cylindrical substrate can be prevented from interfering with each other, by changing the positions of the nozzles. Further, the cleaning method and cleaning apparatus of the present invention become more practical when they are so embodied that an outside diameter detector (sensor) 404 for detecting the outside diameter of the cylindrical substrate is provided near a work stage 405 as a holding means carrying the cylindrical substrate 401 and that on the occasion of cleaning, the nozzles 402 are moved, based on a signal information from the sensor, so as to locate the nozzles at preferred positions for cleaning, as illustrated in FIG. 4B. In the present invention the nozzles may also be moved Independently of each other so as to prevent surfaces A, described above, from overlapping with each other It can be contemplated in that case that the nozzles are moved horizontally while fixing their height, or that they are moved vertically.

Next described is the aluminum substrate preferably used in the present invention. In the electrophotographic photosensitive member where a functional film comprised of an amorphous material comprising silicon atoms as the matrix formed on the cylindrical substrate, the causes of occurrence of abnormally grown portions on the aluminum substrate include (A) dust particles on the substrate, contaminants in the cleaning water in the cleaning and drying steps, etc attach to the substrate and form seeds, and (B) surface defects of the substrate form seeds.

Concerning the cause (A), it is possible to prevent the dust etc. from adhering to the substrate to some extent by cleaning substrate handling places for cutting, cleaning, etc., precisely performing cleaning in a film-forming vessel, and cleaning the substrate surface immediately before formation of deposited film. Further, the substrate can also be effectively cleaned using water as a cleaning liquid, without using the chlorine base solvent such as trichloroethane.

Concerning the cause (B), It is found that defects are generated because of chemical reaction between water and aluminum. It is considered that portions with more impurities (Si etc.) exposed in the aluminum surface create local batteries with normal aluminum portions around them to promote corrosion of the substrate surface, thus generating surface defects on the substrate.

In order to restrain the chemical reaction as described above, it is effective to increase the purity of aluminum. However, when the purity is too high (or when the amount of impurities is too small), flaws, scooping, etc. due to cutting become easier to occur in the cutting step of aluminum. In addition, the aluminum material also becomes costly with increasing purity.

In the present invention, the effect becomes particularly prominent when an aluminum alloy having a total content of Fe+Si+Cu within a range of 0.001 to 1% by weight is used for the cylindrical substrate for the electrophotographic photosensitive member.

If the total content of Fe+Si+Cu contained in the aluminum material is less than 0.001% by weight, defects will appear readily in the surface of the substrate in the processing stage. When a functional film comprised of an amorphous material comprising silicon atoms as the matrix is formed on the cylindrical substrate by the plasma CVD method, deposited film defects will readily occur. In addition, the material cost will also be high.

If the total content of Fe+Si+Cu is greater than 1% by weight, the aforementioned chemical reaction between water and aluminum will be promoted to make surface defects easier to occur. When a functional film comprised of an amorphous material comprising silicon atoms as the matrix is formed on the cylindrical substrate by the plasma CVD method, deposited film defects will readily occur.

Incidentally, in the present invention, the pressure of the cleaning liquid ejected from the nozzles is preferably set within a range of 5 to 50 kgf/cm$^2$. If the ejection pressure is smaller than 5 kgf/cm$^2$ the cleaning effect will be weakened. If the ejection pressure is greater than 50 kgf/cm$^2$ the aforementioned chemical reaction between water and aluminum will be promoted to make surface defects easier to occur. Further, in the present invention, it is preferable that the number of nozzles in the same plane surrounding the substrate be 2 or more, preferably 3 or more, from the aspect of effectively cleaning the substrate.

Next described are procedures of the method of producing the electrophotographic photosensitive member according to the present invention.

An example of the procedures for actually forming the electrophotographic photosensitive member by the electrophotographic photosensitive member producing method of the present invention using the aluminum alloy cylinder as a substrate will be described referring to the substrate cleaning apparatus according to the present invention illustrated in FIG. 5, the cleaning method according to the present invention, described above with FIG. 1, FIGS. 3A to 3C and FIGS. 4A and 4B, and the deposited film forming apparatus illustrated in FIG. 6.

In a lathe with an air damper for precise cutting (mfd. by PNEUMO PRECISION INC.), not illustrated, a diamond cutting tool (trade name: Miracle Bit mfd. by TOKYO DIAMOND) is set at the rake angle of 50° with respect to the center angle of cylinder. Then the substrate is vacuum-chucked in a rotary flange of this lathe, and is out into a mirror-finished surface to obtain the outside diameter of 108 mm under the conditions of a peripheral speed 1000 m/min and a feed speed of 0.01 mm/R, also using a spray of white kerosene from a nozzle attached to the lathe and sucking chips into a vacuum nozzle also attached to the lathe.

Figure 5:
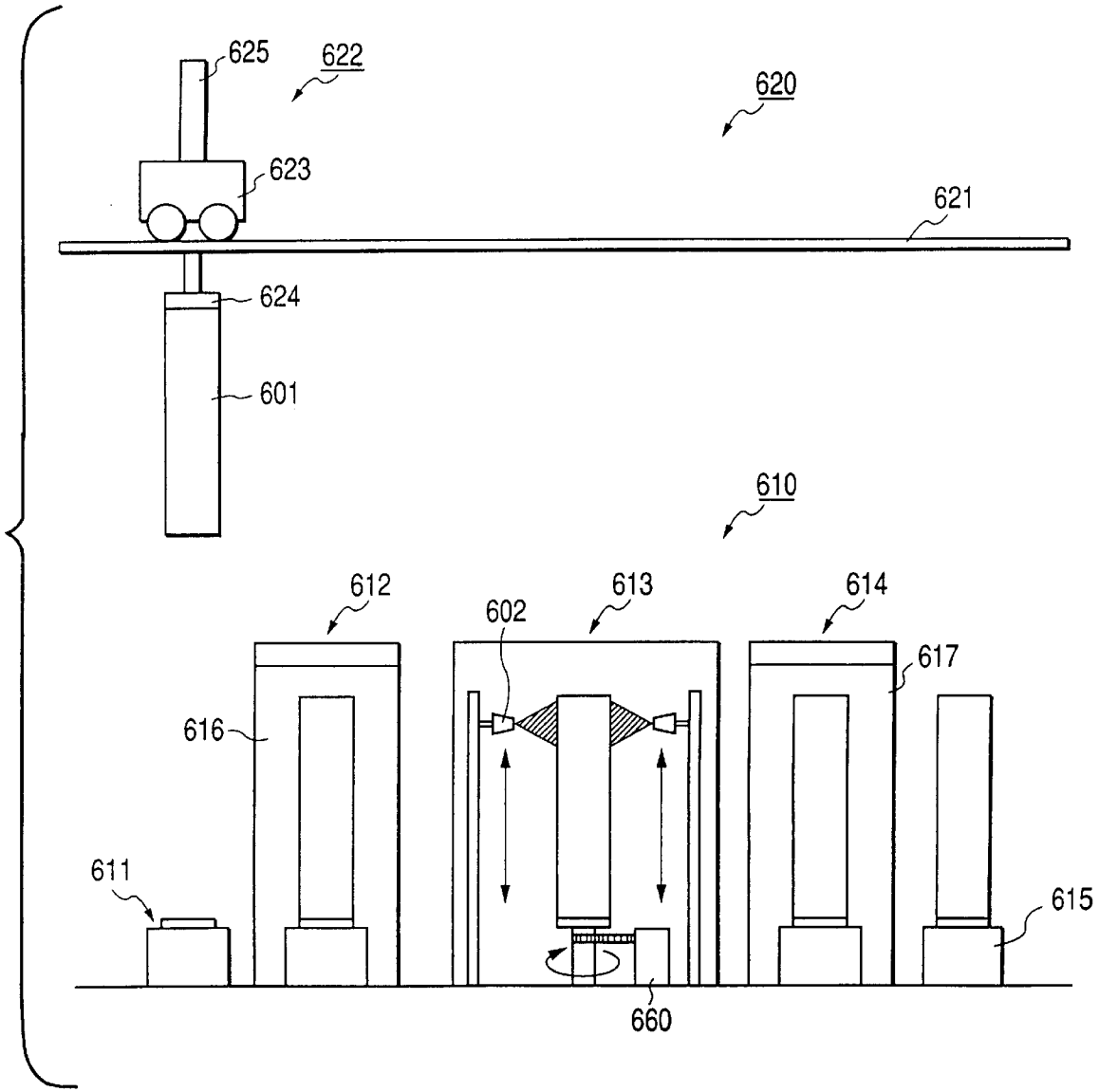
FIG. 5 is a schematic view which shows an example of a substrate cleaning apparatus according to the present invention.

After completion of the cutting, the substrate surface is degreased and cleaned, using the cleaning apparatus illustrated in FIG. 5. The substrate cleaning apparatus is composed of a processing section 610 and a substrate carrying mechanism 620. The processing section 610 is composed of a substrate loading table 611, a substrate cleaning tank 612, a high-pressure shower tank 613, a hot pure water tank (dry tank) 614, and a substrate unloading table 615. Each of the substrate cleaning tank 612 and the hot pure water tank (dry tank) 614 is provided with a temperature controller (not illustrated) for maintaining the temperature of the liquid constant. The carrying mechanism 620 is composed of a carry rail 621 and a carry arm 622. The carry arm 622 is composed of a moving mechanism 623 to move on the rail 621, a chucking mechanism 624 for holding the substrate 601, and an air cylinder 625 for vertically moving the chucking mechanism.

After the cutting, the substrate 601 placed on the loading table 611 is caught at the top end by the carrying mechanism 620 and is lifted up to be carried into the cleaning tank 612. The substrate 601 is subjected to an ultrasonic treatment in the pure water 616 containing the surface active agent, whereby the dust, oil, etc. adhering to the surface is washed away.

Then the substrate 601 is carried into the high-pressure shower tank 613 by the carrying mechanism 620, where the cleaning liquid is ejected from the shower nozzles 602. The shower nozzles 602 are those according to the present invention, which were described above using FIG. 1, FIGS. 3A–3C, and FIGS. 4A and 4B and which are constructed so that the striking surface region at which the cleaning liquid ejected from each nozzle 602 strikes the surface of the cylindrical substrate does not interfere with the other striking surfaces (striking surface regions). In the high-pressure shower tank 613, the nozzles 602 are vertically moved along the substrate 601 and the substrate 601 is rotated by a rotating device 660. This permits the surface of the substrate 601 to be showered uniformly and thoroughly.

Nest, the substrate 601 is moved into the hot pure water tank (drying tank) 614 with hot pure water or the like by the carrying mechanism 620 and pull up drying is carried out by an elevating device (not illustrated) with hot pure water or the like kept at the temperature of 60° C. The hot pure water or the like is controlled in a constant purity by an industrial conductivity meter (trade name: α900R/C mfd. by Horiba Seisakusho). After completion of the drying step, the substrate 601 is carried onto the unloading table 615 by the carrying mechanism 620. After completion of these cutting processing and preliminary treatments, which are the cleaning step and drying step, the substrate is conveyed into the apparatus for forming the deposited film of photoconductive member by the plasma CVD method illustrated in FIG. 6, and a deposited film having the matrix of amorphous silicon is formed thereon by the forming apparatus.

In the present invention, the energy for generating the plasma can be supplied from either one of DC, RF wave, microwave, VHF wave, etc. and, particularly, the substrate cleaned by the cleaning method of the present, invention is preferably used when the energy for generating the plasma is supplied by microwave or VHF wave. As a result, the abnormal growth due to the surface defects of the substrate can be prevented remarkably an the inter-face can be prevented from changing prominently even if the microwave is absorbed by water adsorbing to the surface.

In the present invention, the surface of the substrate may be either one of a mirror-finished surface achieved by a surface treatment to smooth an uneven surface, and a surface as not mirror-finished or a surface as roughened In a desired roughness pattern for the purpose of preventing interference fringes or the like.

In the present invention, as the surface active agent having the high cleaning effect used in the cleaning step, there can be used any one of anionic surface active agents, cationic surface active agents, nonionic surface active agents, amphoteric surface active agents, and mixtures thereof. Among them, the anionic surf ace active agents such as carboxylates, sulfoxylates, sulfates, phosphates, etc. or the nonionic surface active agents such as fatty ester, etc. are particularly effective in the present invention.

In the present invention, when the surface of the aluminum substrate is cleaned, the quality of water before dissolution of the surface active agent can be either grade, but particularly desired water is pure water of the semiconductor grade or ultrapure water of the ultra-LSI grade. Specifically, the minimum resistivity at the temperature of water of 25° C. is not less than 1 MΩ·cm preferably not less than 3 MΩ·cm, and most preferably not less than 5 MΩ·cm in the present invention. The maximum resistivity can take any value up to the theoretical resistivity (18.25 MΩ·cm) and, from the aspect of cost and productivity, the maximum value is not more than 17 MΩ·cm, preferably not more than 15 MΩ·cm, and most preferably not more than 13 MΩ·cm in the present invention.

The amount of particles not smaller than 0.2 $\mu$m in 1 ml of the pure water to not more than 1000 particles, preferably not more than 1000 particles, and most preferably not more than 100 particles in the present invention. The amount of micro-organisms in 1 ml suitable for the present invention is the total viable cell number of not more than 100, preferably not more than 10, and most preferably not more than 1. The total organic content (TOC) in 1 lit. suitable for the present invention is not more than 10 mg, preferably not more than 1 mg, and most preferably not more than 0.2 mg.

Methods for obtaining the water of the above-stated quality include the activated carbon method, distillation method, ion exchange method, filtration method, reverse osmosis method, ultraviolet sterilization method, and so on, and it is desirable to raise the quality to the desired quality of water by using a combination of plural methods selected therefrom.

If the temperature of the pure water containing the surface active agent is too high in the present invention, stains due to liquid traces will occur, so as to be the cause of peeling off of a deposited film or the like. If the temperature is too low, the degreasing effect and film effect will be weak, so as to fail to achieve the full effect of the present invention. Therefore, the temperature of the water suitable for the present invention is 10 to 60° C., preferably 15 to 50° C., and most preferably 20 to 40° C.

In the present invention, when the cylindrical substrate is dipped in the cleaning liquid to be degreased and cleaned or when the cylindrical substrate is subjected to showering, if the concentration of the surface active agent in the cleaning liquid is too high the stains due to liquid traces will occur, so as to be the cause of peeling of f of a deposited film or the like. If the concentration is too low the degreasing effect will be weak, so as to fail to achieve the full effect of the present invention. Therefore, the concentration of the surface active agent suitable for the present invention is 0.1 to 20%, preferably 1 to 10%, and most preferably 2 to 8%.

In the present invention, if the pH of the cleaning liquid containing the surface active agent is too high the stains due to liquid traces will occur, so as to be the cause of peeling off of a deposited film or the like. If the pH is too low the degreasing effect will be weak, so as to fail to achieve the full effect of the present invention. Therefore, the pH of the surface active agent suitable for the present invention is 8 to 12.5, preferably 9 to 12, and most preferably 10 to 11.5.

In the present invention exposure of the cylindrical substrate dipped in the liquid to an ultrasonic wave is effective in achieving the effect of the present invention. The effective range of the frequency of the ultrasonic wave is preferably 100 Hz to 10 MHz, more preferably 1 kHz to 5 MHz, and most preferably 10 to 100 kHz. The effective power of the ultrasonic wave is preferably 0.1 W/1 to 1 kW/1 and more preferably 1 to 100 W/1.

The drying means for the cylindrical substrate suitably applicable to the present invention is the pull up drying using hot pure water or hot pure water having dissolved carbon dioxide.

In the present invention, when the water having dissolved carbon dioxide is used as the liquid in which the substrate is dipped, or as the cleaning solution used for shower, the quality of the water used is very important and the water In the state before dissolution of carbon dioxide is desirably pure water of the semiconductor grade and particularly desirably ultrapure water of the ultra-LSI grade. Specifically, the minimum resistivity at the temperature of water of 25° C. is not less than 1 MΩ·cm, preferably not less than 3 MΩ·cm, and most preferably not less than 5 MΩ·cm in the present invention. The maximum resistivity can take any value up to the theoretical resistivity (18.25 MΩ·cm) and, from the aspect of cost and productivity, the maximum value is not more than 17 MΩ·cm, preferably not more than 15 MΩ·cm, and most preferably not more than 13 MΩ·cm in the present invention.

The amount of particles not smaller than 0.2 $\mu$m in 1 ml of the liquid is not more than 10000 particles, preferably not more than 1000 particles, and most preferably not more than 100 particles in the present invention. The amount of micro-organisms in 1 ml suitable for the present invention is the total viable cell number of not more than 100, preferably not more than 10, and most preferably not more than 1. The total organic content (TOC) in 1 lit. suitable for the present invention is not more than 10 mg, preferably not more than 1 mg, and most preferably not more than 0.2 mg.

Methods for obtaining the water of the above-stated quality include the activated carbon method, distillation method, ion exchange method, filtration method, reverse osmosis method, ultraviolet sterilization method, and so on, and it is desirable to raise the quality to the desired quality of water by using a combination of plural methods selected therefrom.

The amount of carbon dioxide dissolved in these waters can be any amount not more than the saturation solubility thereof in the present invention. However, if the amount is too large, bubbles will be generated with change of the temperature of water to adhere to the surface of the substrate and generate spot-like stains in certain cases. Further, If the dissolving amount of carbon dioxide is large, the pH will be lowered to damage the substrate in certain cases. On the other hand, if the dissolving amount of carbon dioxide is too small, the effect of the present invention will not be achieved. Therefore, the dissolving amount of carbon dioxide needs to be optimized according to circumstances, taking account of the demanded quality of the substrate and the like. In general, a preferred range of the dissolving amount of carbon dioxide according to the present invention is not more than 60% of the saturation solubility and a more preferred range is the condition of 40% thereof.

Further, the dissolving amount of carbon dioxide is managed practically by the electric conductivity or pH of water. In the case of management by the electric conductivity, a preferred range thereof is 2 to 40 $\mu$S/cm, a more preferable range is 4 to 30 $\mu$S/cm, and a further preferable range is 6 to 25 $\mu$S/cm. In the case of management by pH, a preferred range thereof is 3.8 to 6.0 and a more preferred range is 4.0 to 5.0, in which the effect of the present invention is prominent. The measurement of the electric conductivity is carried out using an electric conductivity meter or the like, and the measured values are reduced to values at 25° C. by temperature correction.

The temperature of the water suitably applicable to the present invention is 5 to 90° C., preferably 10 to 55° C., and most preferably 15 to 40° C.

The method of dissolving carbon dioxide into water is any one of a bubbling method, a method using a diaphragm, and so on. Particularly, it is important to use water in which carbonic ions are dissolved. The reason why carbon dioxide is used is that carbon dioxide does not contain sodium. If a carbonate such as sodium carbonate, etc. is used for obtaining carbonic ions, cations such as sodium ions will act to the surface of the substrate, thereby causing abnormal growth or inhibiting deposited films from being formed with high quality. Moreover, when the substrate surface is cleaned with the water having dissolved carbon dioxide, it is also effective to carry out cleaning by dipping before or after the aforementioned spraying method of high-pressure water.

When the substrate is cleaned by dipping, the basic step is to dip the substrate in a water tank, and the effect of the present invention is further enhanced by combination thereof with bubbling or the like by applying the ultrasonic wave, by making water flow, or by introducing air or the like on that occasion.

The cleaning condition by the high-pressure shower in the present invention is that the shower nozzles are set so that the striking surfaces of the cleaning liquid ejected from the respective shower nozzles on the cylindrical substrate do not interfere with each other, and the shape, positions, etc. of the shower nozzles may be properly adjusted as occasion may demand.

In the present invention, too low an ejection pressure of the water will result in weakening the effect of the present Invention, while too high pressure will result in producing patterns like pear skin on an image obtained on the electrophotographic photosensitive member, particularly, on a halftone image. Therefore, the pressure of water suitable for the present invention is 5 to 50 kg·f/cm$^2$, preferably 8 to 40 kg·f/cm$^2$, and most preferably 10 to 30 kg·f/cm$^2$. Here, the unit of the pressure "kg·f/cm$^2$" in the present invention means gravitational kilogram per square centimeter and 1 kg·f/cm$^2$ is equal to 98066.5 Pa.

The spraying methods of water include a method of spraying water highly pressurized by a pump, from nozzles, a method of mixing pumped up Water with high-pressure air before nozzles and spraying the water by the pressure of the air, and so on.

The flow rate of water per substrate suitable for the present invention is 1 to 200 l/min, preferably 2 to 100 l/min, and most preferably 5 to 50 l/min, in terms of the effect of the invention and economical efficiency.

The cleaning liquid ejected from the shower nozzles may be any one of the pure water containing the surface active agent, the pure water, and the pure water having dissolved carbon dioxide, depending upon the structure of the cleaning apparatus. For example, in the case of the apparatus in which the cleaning tank 612 containing the surface active agent and the hot pure water tank (dry tank) 614 with hot pure water or with hot pure water having dissolved carbon dioxide are disposed before and after the shower tank as illustrated in FIG. 5, only the pure water is ejected in the cleaning step so as to accomplish a rinse function.

In the present invention, it is possible to clean the cylindrical substrate only by the shower tank. In this case, the shower nozzles are operated to eject the cleaning liquids in the order of the pure water containing the surface active agent, the pure water, and the hot pure water or hot pure water having dissolved carbon dioxide.

The process time of the cleaning treatment with the water having dissolved carbon dioxide, suitable for the present invention, is 10 seconds to 30 minutes, preferably 20 seconds to 20 minutes, and most preferably 30 seconds to 10 minutes.

When the pure water is used in the cleaning step after the surface processing of the present invention, the quality of the water used is very important and the water is desirably pure water of the semiconductor grade and particularly desirably ultrapure water of the ultra-LSI grade. Specifically, the minimum resistivity at the temperature of water of 25° C. is not less than 1 MΩ·cm, preferably not less than 3 MΩ·cm, and most preferably not less than 5 MΩ·cm in the present invention. The maximum resistivity can take any value up to the theoretical resistivity (18.25 MΩ·cm) and, from the aspect of cost and productivity, the maximum value is not more than 17 MΩ·cm, preferably not more than 15 MΩ·cm, and most preferably not more than 13 MΩ·cm in the present invention.

The amount of particles not smaller than 0.2 $\mu$m in 1 ml is not more than 10000 particles, preferably not more than 1000 particles, and most preferably not more than 100 particles in the present invention. The amount of microorganisms in 1 ml suitable for the present invention is the total viable cell number of not more than 100, preferably not more than 10, and most preferably not more than 1. The total organic content (TOC) in 1 lit. suitable for the present invention is not more than 10 mg, preferably not more than 1 mg, and most preferably not more than 0.2 mg. Methods for obtaining the water of the above-stated quality include the activated carbon method, distillation method, ion exchange method, filtration method, reverse osmosis method, ultraviolet sterilization method, and so on, and it is desirable to raise the quality to the desired quality of water by using a combination of plural methods selected therefrom.

The temperature of the pure water suitable for the present invention is 5 to 90° C., preferably 10 to 55° C., and most preferably 15 to 40° C.

When the substrate surface is cleaned with the pure water obtained as described above, it is preferable to employ the method and time similar to those in the aforementioned technique with the pure water having dissolved carbon dioxide.

In the present invention, when the hot water drying is carried out using the water having dissolved carbon dioxide, the quality of the water used is very important and the water in the state before dissolution of carbon dioxide is desirably pure water of the semiconductor grade and particularly desirably ultrapure water of the ultra-LSI grade. Specifically, the minimum resistivity at the temperature of water of 25° C. is not less than 1 MΩ·cm, preferably not less than 3 MΩ·cm, and most preferably not less than 5 MΩ·cm in the present invention. The maximum resistivity can take any value up to the theoretical resistivity (18.25 MΩ·cm) and, from the aspect of cost and productivity, the maximum value is not more than 17 MΩ·cm, preferably not more than 15 MΩ·cm, and most preferably not more than 13 MΩ·cm in the present invention.

The amount of particles not smaller than 0.2 μm in 1 ml is not more than 10000 particles, preferably not more than 1000 particles, and most preferably not more than 100 particles in the present invention. The amount of micro-organisms in 1 ml suitable for the present invention is the total viable cell number of not more than 100, preferably not more than 10, and most preferably not more than 1. The total organic content (TOC) in 1 lit. suitable for the present invention Is not more than 10 mg, preferably not more than 1 mg, and most preferably not more than 0.2 mg.

The methods for obtaining the water of the above-stated quality include the activated carbon method, distillation method, ion exchange method, filtration method, reverse osmosis method, ultraviolet sterilization method, and so on, and it is desirable to raise the quality to the desired quality of water by using a combination of plural methods selected therefrom.

The amount of carbon dioxide dissolved in these waters can be any amount not more than the saturation solubility thereof in the present invention. However, if the amount is too large, bubbles will be generated with change of the temperature of water to adhere to the surface of the substrate and generate spot-like stains in certain cases. Further, if the dissolving amount of carbon dioxide is large, the pH will be lowered to damage the substrate in certain cases. On the other hand, if the dissolving amount of carbon dioxide is too small, the effect of the present invention will not be achieved.

Therefore, the dissolving amount of carbon dioxide needs to be optimized according to circumstances, taking account of the quality demanded for the substrate and the like.

In general, a preferred range of the dissolving amount of carbon dioxide according to the present invention is not more than 60% of the saturation solubility and a more preferred range is the condition of 40% thereof.

In the present invention, the dissolving amount of carbon dioxide is managed practically by the electric conductivity or pH of water. In the case of management by the electric conductivity, a preferred range thereof is 5 to 40 μS/cm, a more preferable range is 6 to 35 μS/cm, and a further preferable range is 8 to 30 μS/cm. In the case of management by pH, a preferred range is 3.8 to 6.0 and a more preferred range is 4.0 to 5.0, in which the effect of the present invention is prominent. The measurement of the electric conductivity is carried out using the electric conductivity meter or the like, and measured values are reduced to values at 25° C. by temperature correction.

The method of dissolving carbon dioxide into water is any one of a bubbling method, a method using a diaphragm, and so on. In the present invention, it is important to use water in which carbon dioxide is dissolved. When a carbonate such as sodium carbonate, etc. is used for obtaining carbonic ions, cations such as sodium ions will obstruct the effect of the present invention.

The temperature of the hot water suitable for the present invention is 30 to 90° C., preferably 35 to 80° C., and most preferably 40 to 70° C. The pulling up rate during the pull up drying is very important and the range thereof is preferably 100 to 2000 mm/min, more preferably 200 to 1000 mm/min, and further preferably 300 to 1000 mm/min in the present invention.

If the time from the cleaning process with the water having dissolved carbon dioxide to loading into the deposited film forming apparatus is too long, the effect of the present Invention will be weakened. If the time is too short, the steps will not be stable. Therefore, the time suitable for the present invention is 1 minute to 8 hours, preferably 2 minutes to 4 hours, and most preferably 3 minutes to 2 hours.

When the pure water is used in the drying step, the quality of the water used is very important and the water is desirably pure water of the semiconductor grade and particularly desirably ultrapure water of the ultra-LSI grade. Specifically, the minimum resistivity at the temperature of water of 25° C. is not less than 1 MΩ·cm, preferably not less than 3 MΩ·cm, and most preferably not less than 5 MΩ·cm in the present invention. The maximum resistivity can take any value up to the theoretical resistivity (18.25 MΩ·cm) and, from the aspect of cost and productivity, the maximum value is not more than 17 MΩ·cm, preferably not more than 15 MΩ·cm, and most preferably not more than 13 MΩ·cm in the present invention.

The amount of particles not smaller than 0.2 μm in 1 ml is not more than 10000 particles, preferably not more than 1000 particles, and most preferably not more than 100 particles in the present invention. The amount of micro-organisms in 1 ml suitable for the present invention is the total viable cell number of not more than 100, preferably not more than 10, and most preferably not more than 1. The total organic content (TOC) in 1 lit. suitable for the present invention is not more than 10 mg, preferably not more than 1 mg, and most preferably not more than 0.2 mg.

The methods for obtaining the water of the above-stated quality include the activated carbon method, distillation method, ion exchange method, filtration method, reverse osmosis method, ultraviolet sterilization method, and so on, and it is desirable to raise the quality to the desired quality of water by using a combination of plural methods selected therefrom.

The temperature of the pure water suitable for the present invention is 30 to 90° C., preferably 35° C. to 80° C., and most preferably 40 to 70° C. When the substrate surface is cleaned with the pure water obtained in this way, it is preferable to employ the method and time similar to those in the aforementioned technique with the pure water having dissolved carbon dioxide.

It is effective in the present invention to add magnesium to the substrate in order to enhance workability of the substrate. The preferred range of magnesium content is 0.1 to 10% by weight and a further preferable range thereof is 0.2 to 5% by weight.

Further, it is also effective in the present invention to add to aluminum any substance such as H, Li, Na, K, Be, Ca, Ti, Cr, Mn, Fe, Co, Ni, Cu, Ag, Zn, Cd, Hg, B, Ca, In, C, Si, Ge, Sn, N, P, As, O, S, Se, F, Cl, Br, I, etc.

The shape of the substrate in the present invention is determined as desired. For example, when used for electrophotography and in a continuous high-speed copying machine, the optimum shape in the present invention is an endless belt shape or a cylindrical shape as described above. In the case of the cylindrical substrate, there are no specific restrictions on the size of the substrate, but the practically preferred size is the diameter in the range of 20 mm to 500 mm and the length in the range of 10 mm to 1000 mm. The thickness of the support is properly determined so as to permit the photoconductive member to be formed as desired. In the case wherein the photoconductive member is required to have flexibility, it can be made as thin as possible within the scope where the function as a support can be demonstrated well. However, in that case, the thickness is normally not less than 10 $\mu$m in terms of production and handleability of the support, mechanical strength, and so on.

The photosensitive member used in the present invention can be any one of amorphous silicon photosensitive members selenium photosensitive members, cadmium sulfide photosensitive members, organic photosensitive members, and so on, and the effect of the present invention is outstanding when the photosensitive member is a non-monocrystalline photosensitive member containing silicon, such as an amorphous silicon photosensitive member.

Next described is the method of producing the electrophotographic photosensitive member according to the present invention. FIG. 7A and FIG. 7B are drawings to show respective layer structures of electrophotographic photosensitive members produced according to the present invention. FIG. 6 is a schematic view showing an example of an apparatus for producing the electrophotographic photosensitive member according to the present invention.

Figure 6:
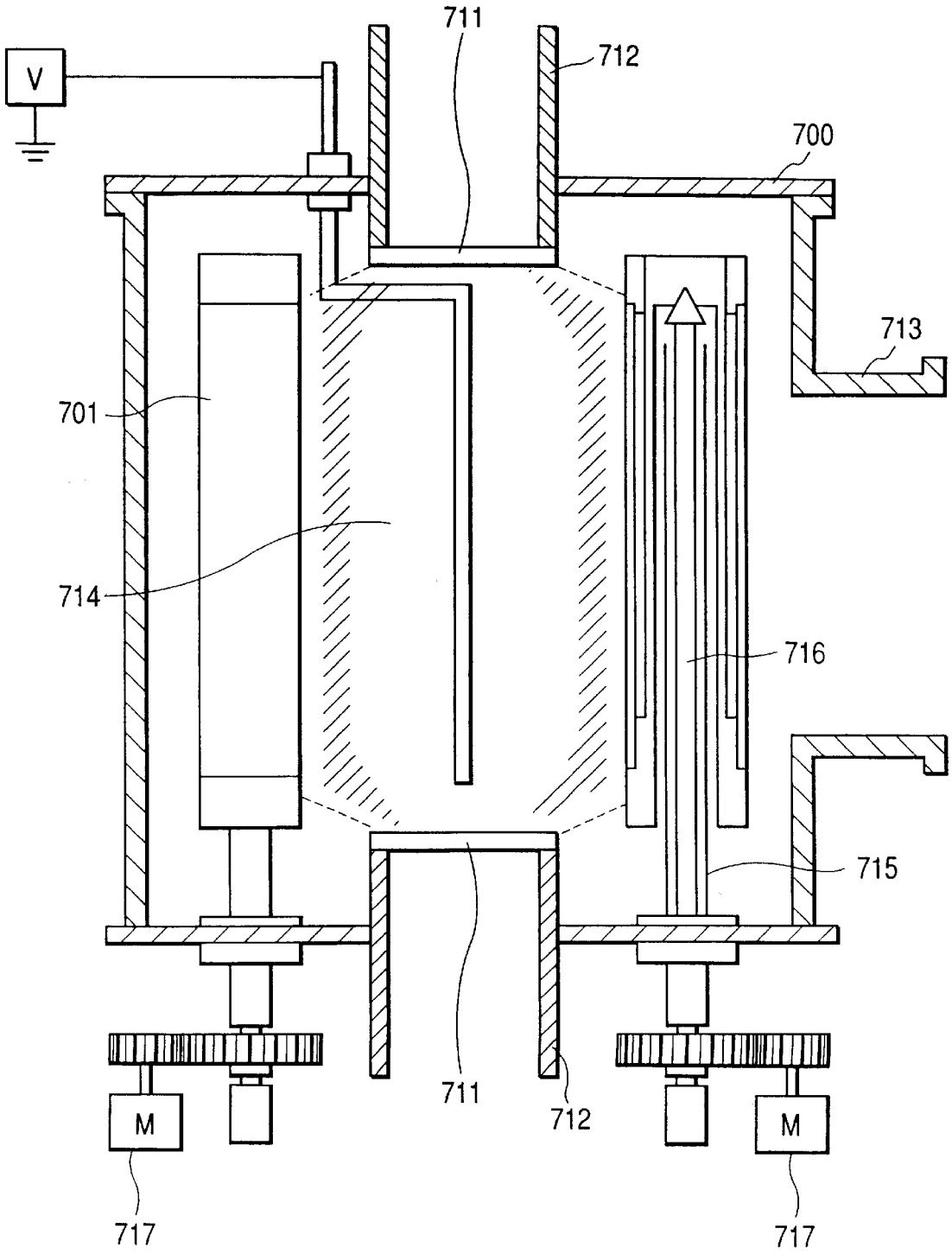
FIG. 6 is a schematic view which shows an example of a deposited film forming apparatus used for the present invention.
Figure 7A:
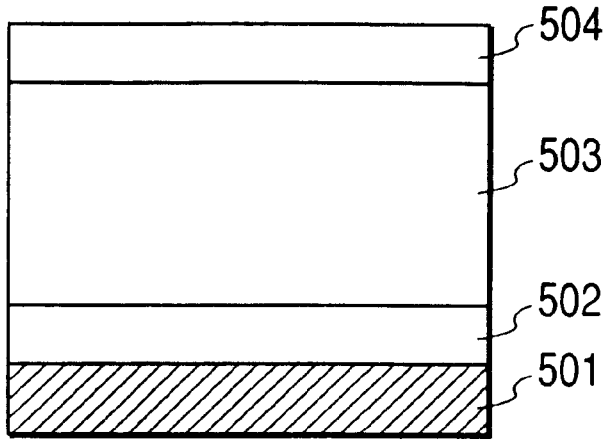
FIGS. 7A and 7B are schematic views which show layer structures of electrophotographic photosensitive members as made according to the present invention.
Figure 7B:
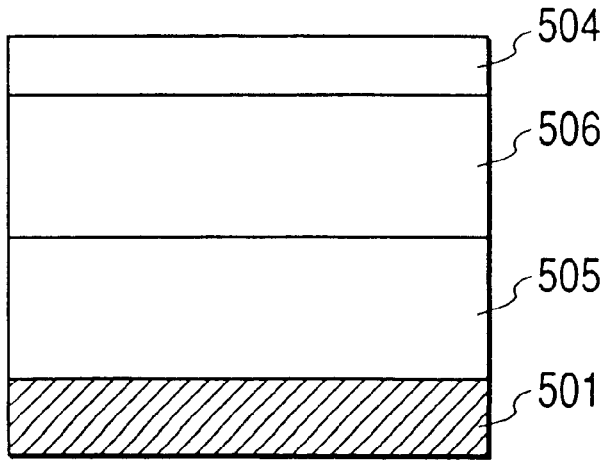

In FIG. 6, a reaction vessel 700 of the cylindrical shape for formation of deposited films is constructed in a vacuum gastight structure capable of being substantially hermetically closed, i.e., capable of controlling the internal pressure to not more than $1\times10^{-4}$ Pa. The reaction vessel is of the cavity resonator structure to resonate at the oscillation frequency of a microwave power supply (not illustrated) in order to start discharge by self-induced discharge without using a discharge trigger or the like. Microwave inlet dielectric windows 711 are formed of a material that efficiently transmits the microwave power into the reaction vessel and that can maintain the vacuum gastight state (for example, quartz glass, alumina ceramics, etc.), and each window is hermetically sealed on an internal wall of a cylindrical part of waveguide 712 in order to maintain the atmosphere inside the reaction vessel 700.

The waveguide 712 is composed of a rectangular portion extending from the microwave power supply (not illustrated) to the vicinity of the reaction vessel 700 and a cylindrical part put in the reaction vessel 700, and works to transmit the microwave power while being connected, together with a stab tuner (not illustrated) and an isolator (not illustrated), to the microwave power supply (not illustrated). An exhaust pipe 713 is opening at one end in the reaction vessel 700 and is in communication at the other and with an exhaust device (not illustrated).

A discharge space 714 is a space surrounded by cylindrical substrates 701 for deposited film formation. Further, this deposited film forming apparatus is provided with heaters 715 for heating the substrates, source gas pipes (not illustrated), rotational shafts 716, and rotary motors 717.

The formation of deposited films for the electrophotographic photosensitive members by the deposited film forming apparatus illustrated in FIG. 6 is carried out as follows.

First the substrates 701 for formation of deposited films subjected to cutting and cleaning according to the present invention by the aforementioned steps are set in the reaction vessel 700. Then the reaction vessel 700 is again closed and the reaction vessel 700 is evacuated through the exhaust pipe 713 by a vacuum pump (not illustrated), so that the pressure inside the reaction vessel 700 is controlled to not more than $1\times10^{-4}$ Pa.

Then the substrates 701 are heated by the heaters 715, so that the temperature of the substrates 701 is maintained at a preferred temperature for film deposition. Then the source gas, for example, silane gas and the like in the case of formation of amorphous silicon deposited films, is introduced through a source gas supply pipe (not Illustrated) into the reaction vessel 700. In tandem therewith, the microwave of the frequency of 2.45 GHz is generated by the microwave power supply (not illustrated) and the microwave energy is guided through the waveguide 712 and through the microwave inlet dielectric window 711 into the reaction vessel 700.

In the discharge space 714 surrounded by the substrates 701, the source gas is thus excited and dissociated by the microwave energy to produce neutral radical particles, ion particles, electrons, and so on, and they react with each other to form a deposited film on the surfaces of the substrates 701. At this time the rotational shafts 716 on which the substrates 701 are set are rotated by the motors 717 to rotate the substrates 701 about the center axis extending in the direction of the generating line of each substrate, whereby the deposited film is uniformly formed throughout the entire circumference of each substrate 701.

The photosensitive members can be made in the is layer structure illustrated in FIG. 7A or 7B, depending upon the purpose. FIG. 7A is a sectional view to show an example of the layer structure of a blocking photosensitive member. In the figure, reference numeral 501 designates a substrate, 502 a charge injection blocking layer, 503 a photoconductive layer, and 504 a surface protecting layer. The blocking photosensitive member is formed by successively depositing the layers under the conditions of desired source gas, microwave power, pressure, and so on for each layer. FIG. 7B is a sectional view to show an example of the layer structure of a function separation type photosensitive member. In the figure, numeral 501 denotes a substrate, 505 a charge transport layer, 506 a charge generating layer, and 504 a surface protecting layer.

In the present invention, the source gas used in production of the electrophotographic photosensitive member is selected as follows. For example, for forming amorphous silicon, gaseous or gasifiable silicon hydrides (silanes), such as $SiH_4$, $Si_2H_6$, $Si_3H_8$, and $Si_4H_{10}$, are effectively used an gases for supply of Si. In addition to the silicon hydrides, effective substances as gases for supply of Si in the present invention also include silicon compounds containing fluorine atoms, so called silane derivatives substituted by fluorine; specifically, gaseous or gasifiable substances such as silicon fluorides such as $SiF_4$ and $Si_2F_6$, fluorine-substituted silicon hydrides such as $SiH_3F$, $SiH_2F_2$, and $SiHF_3$, and so on. The present invention will not be affected at all even if these source gases for supply of Si are used as diluted with a gas such as $H_2$, He, Ar, or Ne if necessary.

In addition to the above gas, the atoms belonging to Group III of the periodic table or the atoms belonging to Group V of the periodic table can also be used as a so-called dopant if necessary. For example, when boron atoms (B) are used as a dopant, the dopant material includes boron hydrides such as $B_2H_6$, $B_4H_{10}$, etc., boron halides such as $BF_3$, $BCl_3$, etc., and so on. When phosphorus atoms are used as a dopant, the dopant material includes phosphorus hydrides such as $PH_3$, $P_2H_4$, etc. and phosphorus halides such as $PH_4I$ $PF_3$, $PCl_3$, $PBr_3$, $PI_3$, etc., and the like.

For example, in the case of the blocking photosensitive member illustrated in FIG. 7A in the present invention, the thickness of the photoconductive layer 503 is properly determined as desired from the aspect of achieving desired electrophotographic characteristics, economical effect, and so on, and the thickness is preferably 15 to 50 $\mu$m, more preferably 20 to 45 $\mu$m, and most preferably 25 to 40 $\mu$m.

For forming the photoconductive layer accomplishing the objects of the present invention and having desired film characteristics, it is necessary to properly set the mixture ratio of the gas for supply of Si with a dilution gas, the pressure of gas in the reaction vessel, the discharge power, and the temperature of the substrate.

The optimum range of flow rate of $H_2$ used as a dilution gas is properly selected according to the design of the layer, and $H_2$ is desirably controlled to be changed, normally, in the range of 1 to 20 times, preferably in the range of 2 to 15 times, and most preferably in the range of 3 to 10 times the gas for Si supply.

The optimum range of the discharge power is also properly selected depending upon the design of layer and the structure of the deposition apparatus, and, for achieving the sufficient deposition rate and film characteristics, the discharge power (W) over the flow rate of the gas for Si supply (W) is desirably set normally in the range of 2 to 20 times, preferably in the range of 2.5 to 10 times, and most preferably in the range of 3 to 5 times.

Further, the optimum range of the temperature of substrate 501 is properly selected according to the design of layer and, in the normal case, it is preferably 200 to 350° C., more preferably 230 to 330° C., and most preferably 250 to 310° C.

In the present invention, the desired numerical ranges of the substrate temperature and gas pressure for formation of the photoconductive layer 503 are those described above, but, normally, the conditions cannot be determined independently of each other. The optimum values are desirably determined, based on mutual and organic relation so as to form the light receiving member having desired characteristics.

The charge injection blocking layer 502 has the function to inhibit charge from being injected from the substrate into the photoconductive layer when the free surface of the light receiving layer is charged in a fixed polarity. Such function is not demonstrated when the surface is charged in the opposite polarity. Therefore, the blocking layer 502 has the so-called polarity dependence. For imposing such function, the charge injection blocking layer contains a relatively larger amount of the atoms for controlling the conductivity type than the photoconductive layer.

The atoms for controlling the conductivity type, contained in the blocking layer, may be uniformly distributed throughout the layer, or may be nonuniformly distributed in part, though contained throughout the layer in the layer thickness direction. In the case of the nonuniform distribution, it is preferable to distribute more atoms on the substrate It is, however, necessary in either case to uniformly distribute the atoms throughout the layer in the in-plane directions parallel to the surface of the substrate in order to uniform the characteristics in the in-plane directions.

As the atoms for controlling the conductivity type contained in the charge injection blocking layer 502, there can be included the so-called impurities in the semiconductor field, and the atoms belonging to Group IIIb of the periodic table to provide the p-type conductivity (hereinafter abbreviated as "Group IIIb atoms") or the atoms belonging to Group Vb of the periodic table to provide the n-type conductivity (hereinafter abbreviated as "Group Vb atoms").

Specific examples of Group IIIb atoms include B (boron), Al (aluminum), Ga (gallium), In (indium), Tl (thallium), and so on and, particularly, B, Al, and Ga are preferable. Specific examples of Group Vb atoms are P (phosphorus), As (arsenic), Sb (antimony), Bi (bismuth), and so on and, particularly, P and As are preferable.

The content of the atoms for controlling the conductivity type, contained in the charge injection blocking layer, is properly determined according to the desire to effectively achieve the objects of the present invention and is preferably 10 to $1\times10^{-4}$ atomic ppm, more preferably 50 to $5\times10^{-}$ atomic ppm, and most preferably $1\times10^{-2}$ to $1\times10^{-3}$ atomic ppm.

Further, when the charge injection blocking layer contains at least one of carbon, nitrogen, and oxygen, the adhesion thereof can be further enhanced to the other layers provided in direct contact with the charge injection blocking layer.

The carbon atoms or nitrogen atoms or oxygen atoms contained in the blocking layer may be uniformly distributed throughout the layer, or may be nonuniformly distributed in part, though contained throughout the layer in the layer thickness direction.

It is, however, necessary in either case to uniformly distribute the atoms throughout the layer in the in-plane directions parallel to the surface of the substrate in order to uniform the characteristics in the in-plane directions.

The thickness of the charge injection blocking layer is preferably 0.1 to 5 $\mu$m, more preferably 0.3 to 4 $\mu$m, and most preferably 0.5 to 3 $\mu$m from the aspect of achieving the desired electrophotographic characteristics, economical effect, and so on.

For forming the charge injection blocking layer 502, it is also necessary to properly set the mixture ratio of the gas for Si supply with the dilution gas, the pressure of the gas in the reaction vessel, the discharge power, and the temperature of the substrate 501, as is the case with the formation of the photoconductive layer described previously.

The optimum range of the flow rate of $H_2$ and/or He as the dilution gas is properly selected according to the design of the layer, and $H_2$ and/or He is normally in the range of 1 to 20 times, preferably in the range of 3 to 15 times, and most preferably in the range of 5 to 10 times the gas for Si supply.

The optimum range of the discharge power is also properly selected depending upon the design of the layer and the structure of the deposition apparatus, and the discharge power (W) over the flow rate of the gas for Si supply (N) is set normally in the range of 1 to 7 times, preferably in the range of 2 to 6 times, and most preferably in the range of 3 to 5 times.

Further, the optimum range of the temperature of the substrate 501 is properly selected according to the design of the layer, and, in the normal case, it is preferably 200 to 350° C., more preferably 230 to 330° C., and most preferably 250 to 310° C.

The surface layer 504 can be formed of any material that is an amorphous base material. For example, preferred materials include amorphous silicon containing hydrogen atoms (H) and/or halogen atoms (X) and further containing carbon atoms (hereinafter referred to as "a-SiC:H,X"), amorphous silicon containing hydrogen atoms (H) and/or halogen atoms (X) and further containing oxygen atoms (hereinafter referred to as "a-SiO:H,X"), amorphous silicon containing hydrogen atoms (H) and/or halogen atoms (X) and further containing nitrogen atoms (hereinafter referred to as "a-SiN:H,X"), amorphous silicon containing hydrogen atoms (H) and/or halogen atoms (X) and further containing at least one of carbon, oxygen, and nitrogen (hereinafter referred to as "a-SiCON:H,X"), and so on.

The surface layer 504 is produced by the vacuum deposited film forming method while numerical conditions of film-forming parameters are properly set so as to obtain desired characteristics. The surface layer is preferably made by the same deposition method as those for the photoconductive layer and for the charge injection blocking layer in terms of productivity of the light receiving member.

The material for the surface layer 504 can be any amorphous material containing silicon, but a preferred material is a compound of silicon atoms and at least one element selected from carbon, nitrogen, and oxygen. Particularly, a compound having the principal component of a-SiC Is preferably used.

Substances that can be gases for supply of silicon (Si), used in formation of the surface layer 504, are gaseous or gasifiable silicon hydrides (silanes) such as $SiH_4$, $Si_2H_6$, $Si_3H_8$, $Si_4H_{10}$, etc., which can be used effectively. Further, $SiH_4$ and $Si_2H_6$ are particularly preferable from the aspects of easiness to handle during preparation of the layer, high Si supply efficiency, and so on. When using these source gases for supply of Si, they may be diluted with a gas such as $H_2$, He, Ar, Ne, etc. if necessary.

Substances that can be gases for supply of carbon are gaseous or gasifiable hydrocarbons such as $CH_4$, $C_2H_6$, $C_3H_8$, $C_4H_{10}$, etc., which can be used effectively. Further, $CH_4$ and $C_2H_6$ are particularly preferable in terms of easiness to handle during preparation of the layer, high C supply efficiency, and so on. Further, when using these source gases for supply of C, they may be diluted with a gas such as $H_2$, He, Ar, Ne, etc. if necessary.

The thickness of the surface layer 504 is normally 0.01 to 3 $\mu$m, preferably 0.05 to 2 $\mu$m, and most preferably 0.1 to 1 $\mu$m. If the thickness of the layer is smaller than 0.01 $\mu$m the surface layer will be lost for the reason of wear or the like during use of the light receiving member. If the thickness is over 3 $\mu$m the electrophotographic characteristics will be degraded; for example, the residual potential will be increased.

Further, the present invention cannot be applied only to the blocking amorphous photosensitive members, but can also be applied to production of any devices, including copying machines using a high-resistance amorphous photosensitive member, a function separation type amorphous photosensitive member, and so on, or photosensitive members for printers.

The present invention will be described in further detail, based on examples thereof, but it should be noted that the present invention is by no means intended to be limited to these examples.

EXAMPLES

Example 1

Cylindrical substrates each containing 0. 06% by weight Si, 0.04% by weight Fe, and 0.02% by weight Cu and measuring the diameter 108 mm, the length 358 mm, and the thickness 5 mm were subjected to cutting of the surface in the similar fashion to that in the procedures of the production method of electrophotographic photosensitive member of the present invention described above.

Ten minutes after completion of the cutting, the cylindrical substrates were cleaned under the cleaning conditions shown in Table 1 by the cleaning apparatus illustrated in FIG. 5

The cleaning was carried out so that the striking surfaces (surface regions) of showers on the surface of each cylindrical substrate in the high-pressure shower tank did not interfere with each other as illustrated in FIG. 1.

TABLE 1

(Cleaning conditions)

| Cleaning conditions | Substrate cleaning tank | High pressure shower tank | Drying tank |
|---|---|---|---|
| Cleaning fluid & others | pure water + surfactant (ultrasonic treatment) | aqueous carbon dioxide solution (20 $\mu$S/cm); ejection pressure: 10 kgf/cm$^2$ | carbon dioxide solution (20 $\mu$S/cm); pulling up rate: 8 mm/sec |
| Temperature | 35 to 45° C. | 22 to 28° C. | 40 to 50° C. |
| Cleaning time | 180 sec | 60 sec | 60 sec |

Using the cylindrical substrates of aluminum thus cleaned, formation of the blocking light receiving members for electrophotography (hereinafter referred to as a drum) in the layer structure comprised of the charge injection blocking layers, the photoconductive layer, and the surface layer, illustrated in FIG. 7A, was carried out by five cycles by the deposited film forming apparatus illustrated in FIG. 6, and the drum prepared in each cycle was set in the electrophotographic apparatus (modified for tests from NP6750 mfd. by CANON K. K.). Then evaluation of electrophotographic characteristics shown in Table 2 was conducted according to the methods described below.

TABLE 2

(Electrophotographic characteristic evaluation)

| | Charge injection blocking layer | Photoconductive layer | Surface layer |
|---|---|---|---|
| Flow rates of source gases (sccm) | $SiH_4$ 300<br>$H_2$ 100<br>$B_2H_6$ 500 ppm (relative to $SiH_4$) | $SiH_4$ 300<br>$B_2H_6$ 1.5 ppm (relative to $SiH_4$) | $SiH_4$ 30<br>$H_2$ 100<br>$CH_4$ 500 |
| Microwave power (W) | 1200 | 1500 | 1500 |
| Bias voltage | 80 V | 80 V | 80 V |
| Inner pressure (mTorr) | 10 | 10 | 10 |

(Halftone Image Irregularities)

A halftone chart (part number: FY9-9042) manufactured by CANON K. K. was placed on the original plate and copies thereof were obtained under irradiation with the ordinary exposure amount and with double the exposure amount. With the images obtained in this way, image densities were measured at 100 points, each unit representing a circular area of a diameter 5 mm, and variations of the densities were evaluated.

The results are shown in Table 3. In the table, "◎" indicates variations less than 2%, "o" variations not less than 2% but less than 5%, "Δ" variations not less than 5% but less than 10%, and "x" variations not less than 10%.

(Evaluation of Surface Property)

The drums produced were tested by an accelerated durability test and the time taken for occurrence of cleaning failure was evaluated.

The results are shown in Table 4. In the table, "◎" indicates no cleaning failure occurring for 50 hours, "o" a cleaning failure occurring at or after 40 hours, "Δ" a cleaning failure occurring at or after 30 hours, and "x" a cleaning failure occurring before 30 hours.

Comparative Example

Cylindrical substrates of aluminum, similar to those in Example 1, were cut in the similar fashion to that in Example 1 and ten minutes after completion of the cutting the cylindrical substrates were cleaned under the cleaning conditions shown in Table 1 by the cleaning apparatus illustrated in FIG. 5. The striking surfaces (surface regions) of showers on the surface of each cylindrical substrate in the high-pressure shower tank were adjusted as illustrated in FIG. 2.

Using the cylindrical substrates of aluminum cleaned as described above, drums were produced in the similar fashion to Example 1 by the deposited film forming apparatus illustrated in FIG. 6, and the same evaluations were carried out.

The evaluation results of the drums produced in Example 1 and in Comparative Example are shown in Table 3 and Table 4.

TABLE 3

(Halftone image irregularities)

| | first cycle | second cycle | third cycle | fourth cycle | fifth cycle | Average |
|---|---|---|---|---|---|---|
| Example 1 | ◎ | ◎ | ◎ | o | ◎ | ◎ |
| Comparative Example | o | Δ | o | Δ | Δ | Δ |

TABLE 4

(Surface property evaluation)

| | first cycle | second cycle | third cycle | fourth cycle | fifth cycle | Average |
|---|---|---|---|---|---|---|
| Example 1 | ◎ | ◎ | ◎ | ◎ | ◎ | ◎ |
| Comparative Example | o | Δ | o | o | Δ | o |

As shown in Tables 3 and 4, the drums produced in Example 1 of the present invention showed better results than those of Comparative Example.

Example 2

The cleaning was conducted in the same manner as in Example 1, except that the ejection pressure from the nozzles in the high-pressure shower tank was varied. At this time the positions of the nozzles were changed so as to prevent the striking surfaces (surface regions) of showers on the surface of the cylindrical substrate from interfering with each other, according to the ejection pressure.

Using the cylindrical substrates of aluminum cleaned in this way, drums were produced in the same manner as in Example 1 and the same evaluations were carried out.

The evaluation results are shown in Table 5.

TABLE 5

(Evaluation results)

| Shower ejection pressure (kgf/cm$^2$) | 1 | 3 | 5 | 10 | 30 | 50 | 70 | 100 |
|---|---|---|---|---|---|---|---|---|
| Halftone image irregularities | Δ | Δ | ◎ | ◎ | ◎ | ◎ | ○ | ○ |
| Evaluation of surface property | ○ | ◎ | ◎ | ◎ | ◎ | ◎ | ○ | Δ |

As shown in Table 5, the good results were obtained in the range of shower ejection pressure of 5 to 50 kgf/cm$^2$.

Example 3

The cutting and cleaning were carried out in the similar fashion to those in Example 1 with the exception that the content of Fe, Si, and Cu in the aluminum material used was varied.

Using the cylindrical substrates of aluminum cleaned in this way, drums were produced in the same manner as in Example 1 and evaluations of image defects and the surface property were carried out.

(Image Defects)

Each of the electrophotographic photosensitive members thus produced was set in the electrophotographic apparatus (modified for this test from NP6060 mfd. by CANON K. K.), a halftone chart (part number: FY9-9042) manufactured by CANON K. K. was placed on the original plate, and copy images thereof were obtained. The number of white spots having the diameter of not more than 0.5 mm was counted in the same area of the copy images.

The results are shown in Table 6. In the table, "◎" indicates 0 to 2 spots in the same area, "o" 3 to 5 spots, "Δ" 6 to 10 spots, and "x" 11 or more Spots.

(Evaluation of Surface Property)

The surface property was evaluated in the same manner as; in Example 1. The evaluation results are shown in Table 6.

TABLE 6

| Fe + Si + Cu content (% by weight) | 0.0005 | 0.001 | 0.01 | 0.1 | 1.0 | 1.5 | 2.0 |
|---|---|---|---|---|---|---|---|
| Image defects | Δ | ◎ | ◎ | ◎ | ◎ | Δ | Δ |
| Evaluation of surface property | Δ | ◎ | ◎ | ◎ | ◎ | Δ | Δ |

As shown in Table 6, the good results were obtained with the aluminum materials having the content of Fe+Si+Cu in the range of 0.001 to 1.0% by weight.

The present invention provides a good water-based cleaning method of cleaning a cylindrical substrate for an electrophotographic photosensitive member, using pure water, pure water having dissolved carbon dioxide, or pure water containing a surface active agent, wherein those surfaces of a cleaning liquid ejected from a plural nozzles which are in contact with the surface of the cylindrical substrate do not interfere with each other, and the invention can thus provide a good and cheap electrophotographic photosensitive member stably.

Further, the present invention defines, particularly, appropriate showering conditions in a high-pressure shower tank, whereby the marked effect can be achieved, solving the problems of the roughness and surface property of the deposited film, which are caused by a surface reaction due to a chemical reaction between aluminum and water, and the problem of the halftone image irregularities caused by cleaning irregularities, which have been not solved hitherto.

What is claimed is:

1. A method of producing an electrophotographic photosensitive member comprising the steps of:

providing a cylindrical substrate for the electrophotographic photosensitive member by cutting and mirror finishing an aluminum alloy substrate having a total content of Fe+Si+Cu within a range of 0.001 to 1% by weight;

cleaning the cylindrical substrate by ejecting at least one cleaning liquid selected from the group consisting of pure water, pure water having dissolved carbon dioxide, and pure water containing a surface active agent from a plurality of nozzles at an ejection pressure from at least 5 kgf/cm$^2$ to at most 50 kgf/cm$^2$ such that those surfaces of the cleaning liquid ejected from the respective nozzles which are in contact with a surface of the cylindrical substrate do not interfere with each other and the ejection occurs along a longitudinal axis of rotation of the cylindrical substrate, said longitudinal axis being vertically oriented; and forming a functional film comprising a non-monocrystalline material comprising silicon atoms as a main component on the surface of the cylindrical substrate by plasma CVD.

2. The method according to claim 1, wherein the distances between cleaning liquid ejecting ports of the nozzles and the surface of the cylindrical substrate are changed depending on the diameter of the cylindrical substrate.

3. The method according to claim 1, wherein the entire surface of the cylindrical substrate is cleaned by moving either one of the cylindrical substrate and the nozzles.

4. A method of producing an electrophotographic photosensitive member comprising the steps of:

providing a cylindrical substrate for the electrophotographic photosensitive member by cutting and mirror finishing an aluminum alloy substrate having a total content of Fe+Si+Cu within a range of 0.001 to 1% by weight;

cleaning the cylindrical substrate for an electrophotographic photosensitive member by spraying a liquid from mutually different positions at an ejection pressure from at least 5 kgf/cm$^2$ to at most 50 kgf/cm$^2$, wherein the liquid is sprayed onto the cylindrical substrate such that a plurality of regions on the cylindrical substrate to which the liquid is sprayed do not overlap with each other and the spraying occurs along a longitudinal axis of rotation of the cylindrical substrate, said longitudinal axis being vertically oriented; and forming a functional film comprising a non-monocrystalline material comprising silicon atoms as a main component on the surface of the cylindrical substrate by plasma CVD.

5. The method according to claim 4, wherein the liquid is sprayed from positions in the same plane onto the cylindrical substrate.

6. The method according to claim 4, wherein the liquid is sprayed from positions at the same height onto the cylindrical substrate.

* * * * *

UNITED STATES PATENT AND TRADEMARK OFFICE

CERTIFICATE OF CORRECTION

PATENT NO. : 6,321,759 B1
DATED : November 27, 2001
INVENTOR(S) : Ryuji Okamura et al.

It is certified that error appears in the above-identified patent and that said Letters Patent is hereby corrected as shown below:

Title page,
Item [*], Notice, insert -- [*] Notice This patent issued on a continued prosection application filed under 37 CFR 1.53(d), and is subject to the twenty year patent term provisions of 35 U.S.C. 154(a)(2). --
Item [30], Foreign Application Priority Data, insert -- Dec. 22, 1998 (JP) 10-365633 --.

Column 1,
Line 60, "clearing" should read -- cleaning --.

Column 2,
Line 64, "Is" should read -- is --.

Column 3,
Line 37, "recently" should read -- recently. --.

Column 5,
Line 20, "view" should read -- views --.

Column 6,
Line 12, "Thee" should read -- There --;
Line 58, "Inde-" should read -- inde- --; and
Line 60, "other" should read -- other. --.

Column 8,
Line 10, "50°" should read -- 5° --; and
Line 12, "out" should read -- cut --.

Column 9,
Line 27, "surf ace" should read -- surface --; and
Line 46, "1000" should read -- 10000 --.

Column 10,
Line 9, "of f" should read -- off --; and
Line 37, "In" should read -- in --.

Column 13,
Line 28, "Is" should read -- is --.

UNITED STATES PATENT AND TRADEMARK OFFICE

CERTIFICATE OF CORRECTION

PATENT NO. : 6,321,759 B1
DATED : November 27, 2001
INVENTOR(S) : Ryuji Okamura et al.

It is certified that error appears in the above-identified patent and that said Letters Patent is hereby corrected as shown below:

Column 14,
Line 18, "Invention" should read -- invention --.

Column 16,
Line 55, "an" should read -- as --.

Column 17,
Line 65, "substrate" should read -- substrate side. --.

Column 18,
Line 21, "50 to $5x10^{-}$" should read -- 50 to $5x10^{-3}$ --.

Column 19,
Line 24, "Is" should read -- is --.

Signed and Sealed this

Seventh Day of May, 2002

*Attest:*

*Attesting Officer*

JAMES E. ROGAN
*Director of the United States Patent and Trademark Office*